US005201202A

United States Patent [19]

Kam

[11] Patent Number: 5,201,202

[45] Date of Patent: Apr. 13, 1993

[54] DOOR LOCK SECURITY DEVICE

[76] Inventor: Hing K. Kam, 64 Rivergrove Drive, Scarborough, Ontario, Canada, M1W 3T9

[21] Appl. No.: 720,104

[22] Filed: Jun. 24, 1991

[51] Int. Cl.[5] ..... E05B 13/00

[52] U.S. Cl. ..... 70/168; 70/209; 70/232; 70/428; 70/455; 70/DIG. 58

[58] Field of Search ..... 70/416, DIG. 58, 158–173, 70/202, 203, 207, 209, 210–212, 232, 423–428, 455

[56] References Cited

U.S. PATENT DOCUMENTS

| | | | |
|---|---|---|---|
| 200,599 | 2/1878 | Beachman | 70/232 |
| 574,755 | 1/1897 | Oehler | 70/DIG. 58 X |
| 620,091 | 2/1899 | Applin | 70/DIG. 58 X |
| 1,704,854 | 3/1929 | Burgess | 70/168 |
| 1,760,977 | 6/1930 | Duffy | 70/232 |
| 1,829,444 | 10/1931 | Goebel et al. | 709/284 |
| 2,322,347 | 6/1943 | Churchman | 70/232 |
| 2,809,766 | 10/1957 | Anderson | 292/87 X |
| 2,883,850 | 4/1959 | Falck | 70/232 X |
| 3,206,955 | 9/1965 | Horovitz | 70/232 |
| 3,245,240 | 4/1966 | De Forrest | 70/209 |
| 3,264,850 | 8/1966 | Bower | 70/416 |
| 3,340,709 | 9/1967 | Callahan | 70/209 |
| 3,343,386 | 9/1967 | Hall | 70/455 |
| 3,556,571 | 1/1971 | Laub, Jr. | 70/DIG. 58 X |
| 3,660,996 | 5/1972 | Syvertson | 70/DIG. 58 X |
| 3,888,096 | 6/1975 | Huss | 70/DIG. 58 X |
| 3,888,525 | 6/1975 | Kousens | 292/87 |
| 4,428,211 | 1/1984 | Hermann | 70/455 X |
| 4,561,273 | 12/1985 | Robinson | 70/426 |
| 4,631,938 | 12/1986 | Johnson | 70/209 |
| 4,838,059 | 6/1989 | Johnson | 70/209 |

FOREIGN PATENT DOCUMENTS

| | | |
|---|---|---|
| 2561291 | 9/1985 | France . |
| 454672 | 10/1936 | United Kingdom . |

*Primary Examiner*—Lloyd A. Gall
*Attorney, Agent, or Firm*—Bereskin & Parr

[57] ABSTRACT

A door lock security device is disclosed for locking over the shaft of a door lock rotary knob or a door knob. The device comprises an inner cover which is further comprised of first and second shell portions having an opening between them for closing around the shaft of the door lock rotary knob or door knob, an outer cover which substantially encompasses and overlaps the inner cover to sufficiently shield the inner cover to prevent tampering, and a lock for releasably securing the outer cover to the inner cover. When the inner and outer covers are engaged together around the shaft they prevent the door lock rotary knob or the door knob from being manipulated from a closed to an open position. In one embodiment the first and second shell portions of the inner cover are hingedly attached along one edge while in a further embodiment the first and second shell portions are releasably secured together in a closed position at an opposite edge by a clasp. In yet a further embodiment the device has a lip around the opening in the inner cover to provide limited contact between the door lock security device and the door knob or door lock rotary knob to reduce frictional contact.

11 Claims, 4 Drawing Sheets

DOOR LOCK SECURITY DEVICE

FIELD OF THE INVENTION

This invention relates to security devices and particularly a security device for preventing access to a door lock rotary knob or to a door knob.

BACKGROUND OF THE INVENTION

Many devices have been created to secure a door from unauthorized entry. The most common and widely used of such devices are the locking door knob and the dead-bolt lock. Practically every home, office and shop has one or more doors which restrict access through the use of one or both of these locking mechanisms.

As a practical matter, a locking door knob or dead-bolt lock will prevent entry through a door in one direction. In most applications the lock can be disengaged from one side of the door through turning a rotary knob attached to the dead-bolt lock or through engaging a rotary knob or button in the door knob itself. It is possible, although somewhat uncommon, to require a key to unlock the door from either direction.

The inherent problem with locking door knobs and dead-bolt locks is therefore that they typically allow unrestricted entry from one direction. This problem is of concern when one wishes to prohibit unauthorized entry through a door in either direction. For example, in residential burglaries, it is common for the initial entry to be gained through breaking the glass in a door having a window and unlocking the door by reaching in through the broken window. Thieves may also enter a residence through a window or means other than the front door of the premises. Once inside, a burglar can easily unlock the front door and remove goods through the door into an awaiting vehicle. In fact, many burglaries are accomplished in this manner in order to prevent the arousal or suspension that would be created if goods were removed through a window, patio door or other exit.

In addition, the standard locking door knob may not provide sufficient security where an unauthorized person has access to keys or a master key. For example, numerous people including managers, security officers and cleaning staff often have master keys to doors in large buildings or hotels. In new residential neighbourhoods, contractors and construction workers often have master keys to the homes. In these cases the security of a room or building may be compromised where a number of persons have access to keys or master keys.

To provide additional security for a door having a locking door knob or dead-bolt lock, a number of devices have been proposed which can enhance the effectiveness of such locks. The most common of such devices is a cover used to encompass the rotary knob of a dead-bolt door lock, or the door knob itself in the case of a locking knob. Such devices have in the past typically comprised a hinged-type cover which can be closed around a door lock rotary knob or a door knob, or a box-type cover which is permanently mounted to a door around the lock or door knob.

While such devices are generally effective in covering a door lock rotary knob or a door knob to prevent access, it is often possible to circumvent the security system by inserting objects into seams or behind the cover and prying the device apart. For example U.S. Pat. Nos. 4,631,938 and 4,838,059 describe such devices having this inherent disadvantage. Other such devices (for example U.S. Pat. Nos. 3,660,996 and 3,888,096) require permanent attachment and modification of the door which is unacceptable in many circumstances. In yet further instances (such as U.S. Pat. No., 3,340,709) the structure of the device inhibits use on both a dead-bolt door lock rotary knob and a door knob thereby limiting application. Many of these prior devices also comprise a single cover which, when not in use must be stored elsewhere. As such covers are not immediately accessible when locking a door, they are often not used in situations of haste.

SUMMARY OF THE INVENTION

The invention therefore provides a door lock security device which overcomes these disadvantages through the incorporation of a structure which is not conducive to either prying or tampering. The invention also provides a door lock security device which can equally be used on a door lock rotary knob or a door knob. The invention has the further advantage that it can be left permanently in place around the door knob or door lock rotary knob (and is therefore readily available for use at all times) without being mounted directly on the door or requiring an alteration of the existing door or lock structure.

Accordingly, the present invention in one of its aspects provides a door lock security device for locking over the shaft of a door lock rotary knob or door knob, the device comprising an inner cover, said inner cover comprised of first and second shell portions and having an opening between said first and second shell portions for closing around said shaft, an outer cover substantially encompassing and overlapping said inner cover, said outer cover sufficiently shielding said inner cover to prevent tampering with said inner cover, and a lock for releasably securing said outer cover to said inner cover, said inner and said outer covers when engaged together around said shaft preventing said door lock rotary knob or said door knob from being manipulated from a closed to an open position.

In another aspect of the present invention, the first and second shell portions of the inner cover are hingedly attached at one edge and are releasably secured together in a closed position at an opposite edge by a clasp.

In yet a further embodiment, the present invention has a lip around the opening in the inner cover, said lip providing limited contact between the door lock security device and the door knob or the door lock rotary knob to reduce frictional contact therebetween.

Further objects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF PREFERRED EMBODIMENT

Figure 2:
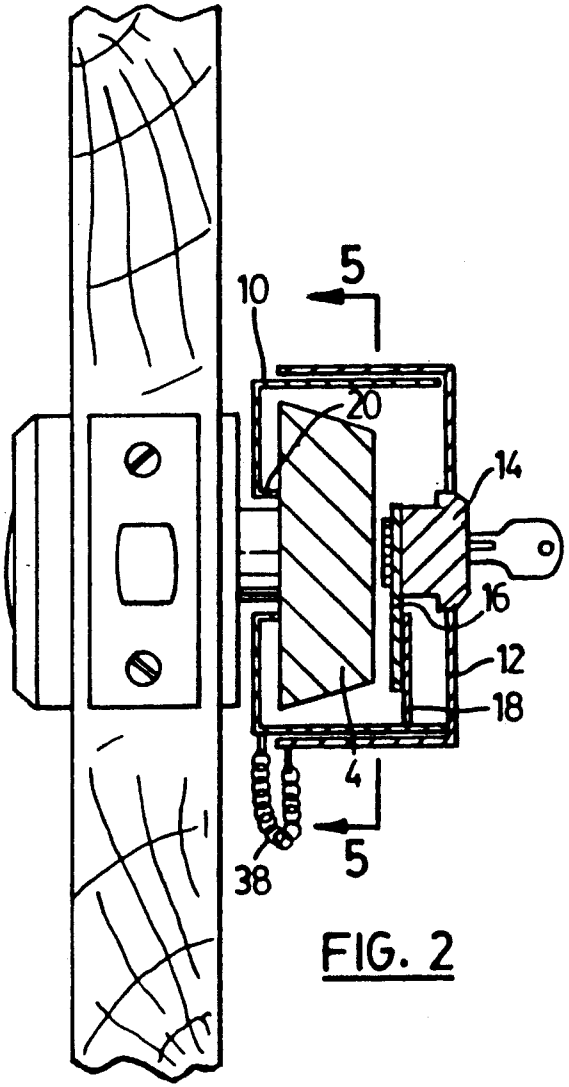
FIG. 2 is a sectional view of the door lock security device shown in FIG. 1.
Figure 1:
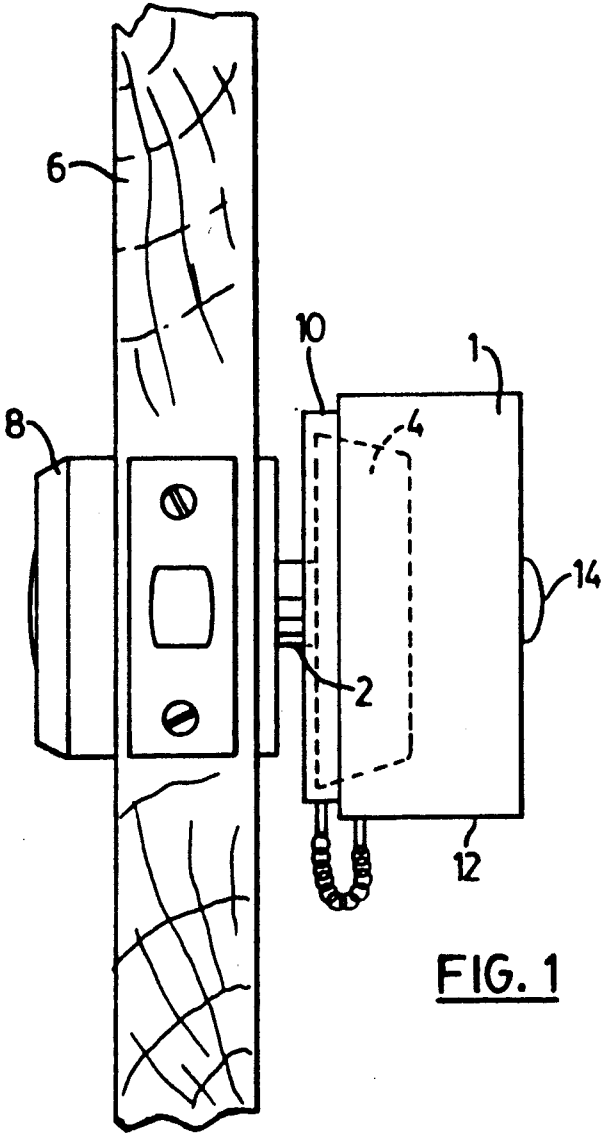
FIG. 1 is a side view of a door lock rotary knob encompassed by the door lock security device of the present invention.

FIG. 1 shows a typical dead-bolt lock 8 mounted on a door 6. Since the details of the dead-bolt lock 8 will be familiar to those skilled in the art, it is not described in any more detail herein. A door lock security device pursuant to the present invention, generally indicated at 1, is shown mounted over a shaft 2 of a door lock rotary knob 4, shown in ghost outline. The door lock security device 1 is comprised generally of an inner cover 10, an outer cover 12 and a lock 14. Referring to the cross-sectional view of the door lock security device 1 as shown in FIG. 2, it can be seen that outer cover 12 substantially encompasses and overlaps inner cover 10 providing a shielding effect in order to prevent tampering with inner cover 10. Outer cover 12 is smooth and seamless and, through substantially encompassing the sides of inner cover 10, does not allow for forcing or prying the covers 10 and 12 apart.

Figure 3:
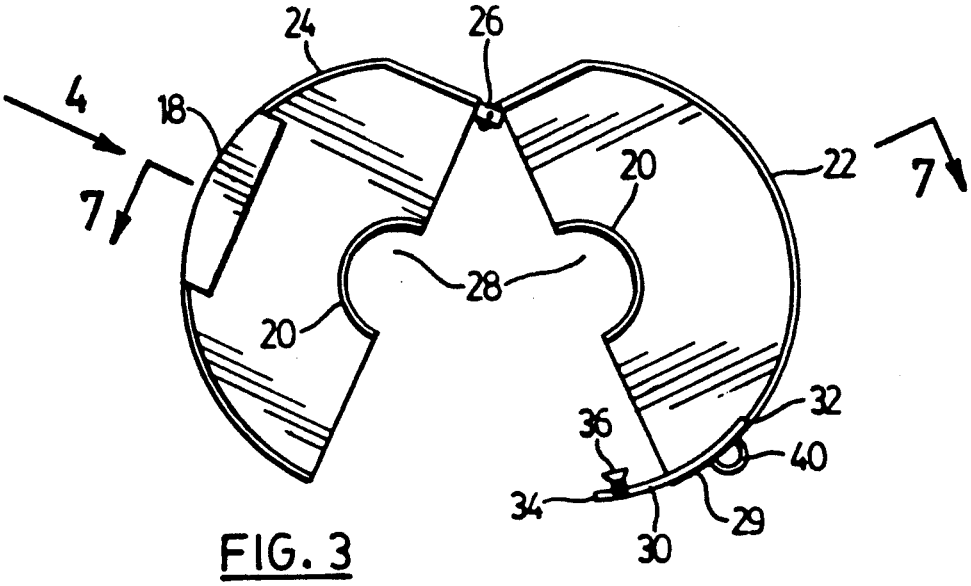
FIG. 3 is a plan view of the inner cover of the door lock security device.
Figure 4:
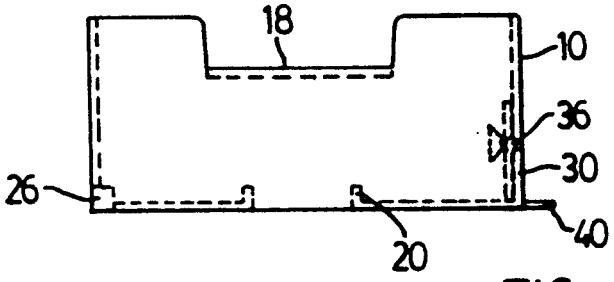
FIG. 4 is a side view of the inner cover of FIG. 3 when in its closed position.

The structure of inner cover 10 is more clearly shown in FIGS. 3 and 4. Inner cover 10 is comprised of first and second shell portions 22 and 24 and has an opening 28 for closing around the shaft 2 of the door lock rotary knob 4. In the preferred embodiment, the first shell portion 22 is hingedly attached to the second shell portion 24 by a hinge 26. Inner cover 10 is therefore what is commonly known as a "clam shell" structure.

In the preferred embodiment, the first shell portion 22 and the second shell portion 24 are releasably secured together in a closed position at an edge opposite the hinge 26 by a clasp generally noted as 29. However, it will be readily apparent to those skilled in the art that through the overlapping of outer cover 12 over inner cover 10, inner cover 10 will be held securely around the shaft 2 of the door lock rotary knob 4. It will also be appreciated that the device may be configured without the aid of the hinge 26 or the clasp 29 provided that the first and second shell portions of inner cover 10 are secured to each other. The hinge 26 and the clasp 29 allow inner cover 10 to remain in place around the shaft 2 when outer cover 12 is removed. In this manner, the invention can be partially disengaged from the door lock rotary knob 4 to prevent access thereto without the necessity of completely removing inner cover 10. The door lock security device 1 therefore may be left in place at all times in order that it is readily available for use. To this extent, outer cover 12 and inner cover 10 include eyelets 40 to which a chain 38 is attached to maintain both inner cover 10 and outer cover 12 in close proximity when disengaged.

According to the present invention, outer cover 12 is releasably secured to inner cover 10 by the lock 14. As is shown in FIG. 2, the lock 14 comprises a locking bar 16 which engages an inwardly projection flange 18 on the side of inner cover 10. For convenience, the inwardly projecting flange 18 is shown on the second shell portion 24 in FIG. 3, however, the inwardly projecting flange 18 could equally be positioned on the first shell portion 22. In use, once outer cover 12 has been placed over inner cover 10 a key 46 for the lock 14 is used to rotate the locking bar 16 such that it engages the inwardly projecting flange 18 to releasably secure outer cover 12 to inner cover 10. The engagement of the locking bar 16 with the inwardly projecting flange 18, and the subsequent securing of outer cover 12 with inner cover 10, is most clearly shown in FIG. 2.

Under the preferred embodiment of the present invention the first shell portion 22 and the second shell portion 24 include a lip 20 around the opening 28. The lip 20 projects into inner cover 10 and is of a sufficient height such that when inner cover 10 is closed around the shaft 2 of the door lock rotary knob 4 there is only limited contact between inner cover 10 and the door lock rotary knob 4 to reduce friction therebetween. Lip 20 therefore has the effect of preventing the door lock security device 1 from being pulled outwardly from the door 6 in an attempt to rotate the door lock rotary knob 4 from its closed to open position through frictional contact with inner cover 10.

Figure 5:
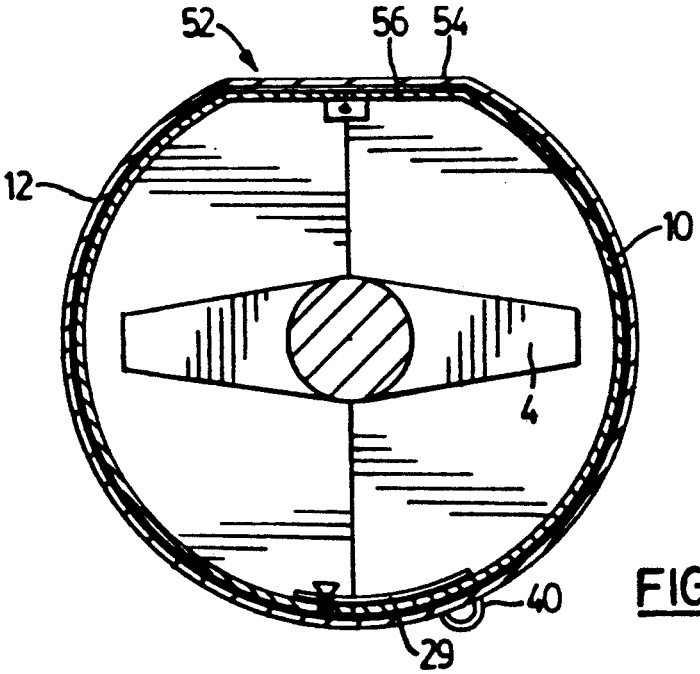
FIG. 5 is a cross-sectional view taken along the line 5—5 of FIG. 2.

Referring to FIGS. 3, 4 and 5, the clasp 29 used to releasably secure the first shell portion 22 and the second shell portion 24 together in a closed position comprises an internal coupling member 30 having a fixed end 32 attached to either the first shell portion 22 or the second shell portion 24. For convenience, the drawings and all further description will refer to the fixed end 32 as being attached to the first shell portion 22. However, it will be realized by one skilled in the art that it is equally possible to accomplish the invention by attaching the fixed end 32 instead to the second shell portion 24.

Internal coupling member 30 also comprises a protruding end 34 which, when the first shell portion 22 and the second shell portion 24 are in their closed position, overlaps the inner surface of the second shell portion 24. A fastener 36 is located on the protruding end 34 of the internal coupling member 30 and is used to releasably secure the first shell portion 22 and the second shell portion 24 together in their closed position.

Typically the fastener 36 would comprise a screw, bolt or pin however, any variety of additional fasteners may also be used including hook and loop fasteners, epoxies, or glue. The degree and ease by which the first shell portion 22 and the second shell portion 24 may be released from their closed position will vary depending upon the specific fastener employed.

Figure 7:
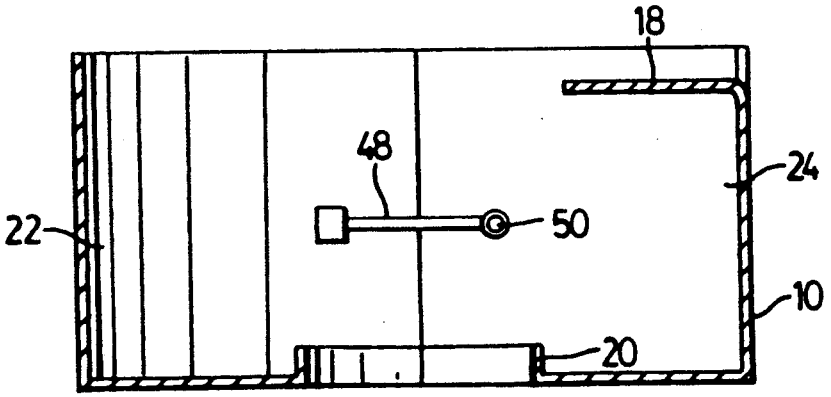
FIG. 7 is a cross-sectional view taken along the line 7—7 of FIG. 3 showing an alternate embodiment of the clasp when the first and second portions of the inner cover are in their closed position.

In a further embodiment of the present invention, the clasp 29 is comprised of a clip 48 fixed to the inner surface of the first shell portion 22 and a post 50 which is fixed to the inner surface of the second shell portion 24, as is more clearly shown in FIG. 7. When the first shell portion 22 and the second shell portion 24 are in their closed position, the clip 48 engages the post 50 in order to releasably secure the first shell portion 22 and the second shell portion 24 together. Once again, it will be readily apparent to one skilled in the art that the clip 48 and the post 50 could be located on opposite shell portions to those as described herein without affecting their function.

The door lock security device 1 also includes means 52 to prevent rotational movement of outer cover 12 about inner cover 10 when outer cover 12 engages and overlaps inner cover 10. As is shown in FIG. 5, means 52 in the preferred embodiment comprises a flattened portion 54 on outer cover 12 which corresponds to a flattened portion 56 on inner cover 10. When outer cover 12 engages and overlaps inner cover 10 the corresponding flattened portions 54 and 56 prevent rotational movement of the covers about themselves.

Figure 6:
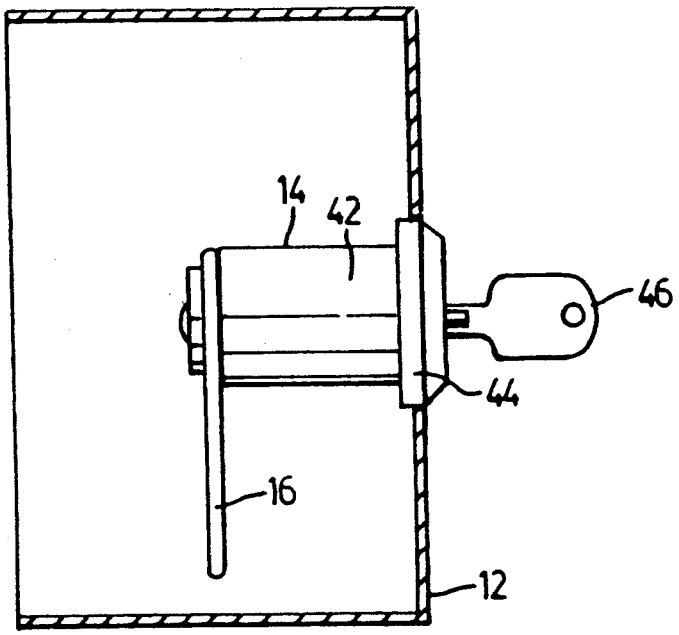
FIG. 6 is a sectional view of the outer cover of the door lock security device.

Referring to FIG. 6, the lock 14, as attached to outer cover 12, is preferably a key actuated cylinder lock comprised generally of a lock cylinder 42 and the locking bar 16. A nut 44 is used to secure the lock cylinder 42 to outer cover 12 by bearing against the inner surface of the outer cover 12 thereby leaving no externally exposed method of tampering. In addition, the lock cylinder 42 is of a length such that the distance between the lock cylinder 42 and the door lock rotary knob 4 is sufficiently small to prevent or impede the "punching" of the lock 14 from outer cover 12 when the door lock security device 1 is in place over the shaft 2 of the door lock rotary knob 4.

Figure 8:
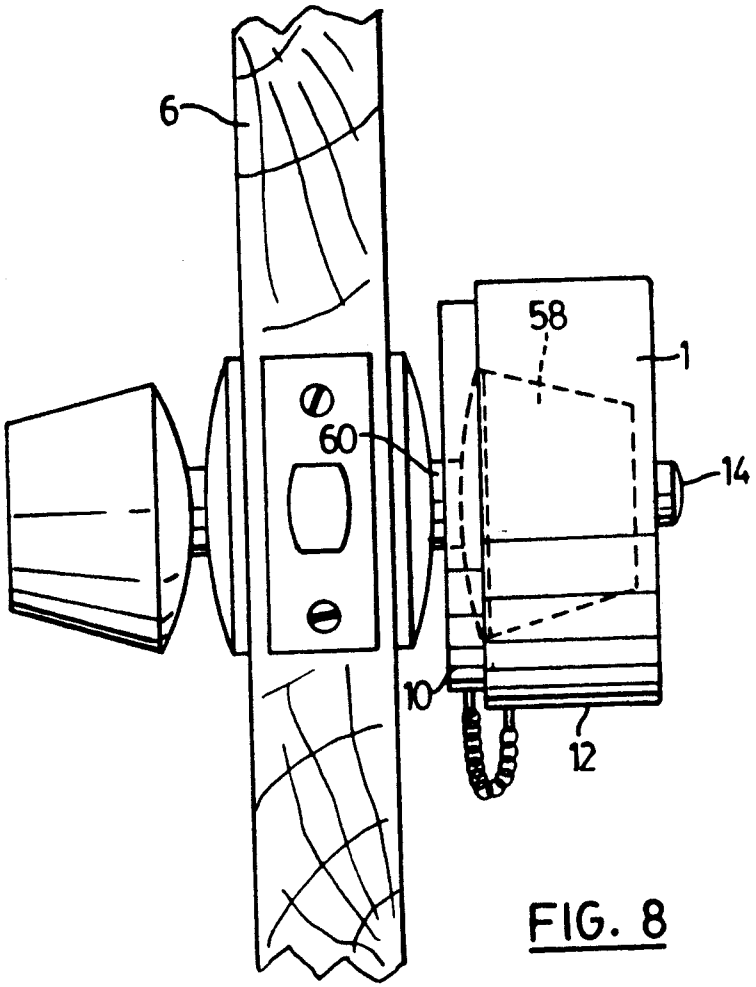
FIG. 8 is a side view showing the door lock security device of the present invention encompassing a door knob.

FIG. 8 shows the door lock security device 1, in an alternate embodiment, mounted over a shaft 60 of a door knob 58, shown in ghost outline. In this embodiment, the structure of the door lock security device 1 is identical to that as described herein however the application is slightly different.

It will be appreciated that in use, the door lock security device 1 provides a means for preventing access to the door lock rotary knob 4 or the door knob 58 and for preventing manipulation of the door lock rotary knob 4 or the door knob 58 from a closed to an open position. The door lock security device 1 comprises an overlapping structure which prevents tampering or prying and is preferably formed from a resilient and impact resistant material, such as steel or brass.

Another advantage of the invention is that when not in use, inner cover 10 may be left closed around the shaft 2 of the door lock rotary knob 4 (or shaft 60 of door knob 58) while outer cover 12 remains attached to inner cover 10 by the chain 38. In this way, the door lock security device 1 is always in place and readily accessible at all times.

It is to be understood that what has been described are the preferred embodiments of the invention and that it is possible to make variations to these embodiments while staying within the broad scope of the invention. Some of these variations have been discussed while others will be readily apparent to those skilled in the art to which this invention relates. In addition, the first shell portion 22 and the second shell portion 24 could be held together at both edges by clasps 29 without the use of the hinge 26.

I claim:

1. A door lock security device for locking over a door lock rotary knob or a door knob, having a shaft of a smaller diameter than the knob, the device comprising:

an inner cover, said inner cover comprised of first and second shell portions which abut along a seam, said inner cover having an opening between said first and said second shell portions for rotatably closing around said shaft, at least one of said first and second shell portions having an inwardly projecting flange, an outer cover substantially encompassing and overlapping said inner cover, said outer cover sufficiently shielding said inner cover to prevent tampering with said inner cover, means to prevent rotational movement of said inner and said outer covers about one another when said outer cover overlaps said inner cover, said means comprising corresponding flattened portions on the sides of said inner and said outer covers, and a single lock for releasably securing said outer cover to said inner cover, said lock being attached to said outer cover and including a locking bar which engages behind said flange to secure said covers together, said inner and said outer covers when engaged together around said shaft allowing rotational movement of said device about said shaft wile preventing removal of said device over said door lock rotary knob or said door knob, and preventing said door lock rotary knob or said door knob from being rotated from a closed to an open position.

2. A door lock security device as claimed in claim 1 wherein said first and said second shell portions of said inner cover are hingedly attached at one edge.

3. A door lock security device as claimed in claim 2 wherein said first and said second shell portions of said inner cover are releasably secured together in a closed position at an opposite edge by a clasp.

4. A door lock security device as claimed in claim 3 having a lip around said opening in said inner cover, said lip providing limited contact between said door lock security device and said door knob or said door lock rotary knob to reduce frictional contact therebetween.

5. A door lock security device as claimed in claim 4 wherein said clasp comprises an internal coupling member having a fixed end and a protruding end, said fixed end rigidly attached to an inner surface of said first shell portion of said inner cover and said protruding end overlapping an inner surface of said second shell portion of said inner cover when said first and said second shell portions are secured together, and a fastener located on said protruding end of said internal coupling member distant said fixed end, said fastener releasably securing said internal coupling member to said second shell portion.

6. A door lock security device as claimed in claim 5 wherein said fastener is a screw, bolt or pin.

7. A door lock security device as claimed in claim 4 wherein said clasp comprises a clip fixed to an inner surface of said first shell portion of said inner cover, and a post fixed to an inner surface of said second shell portion of said inner cover, said clip engaging said post when said first and said second shell portions are in a closed position to releasably secure said first and said second shell portions together.

8. A door lock security device as claimed in claim 4 wherein said inner and said outer covers are connected by a chain.

9. A door lock security device as claimed in claim 6 wherein said inner and said outer covers are made from a resilient and impact resistant material.

10. A door lock security device as claimed in claim 7 wherein said lock is a key actuated cylinder lock.

11. A door lock security device as claimed in claim 7 wherein said inner and said outer covers are made from steel or brass.

* * * * *